US008727152B2

(12) United States Patent
Strasser et al.

(10) Patent No.: US 8,727,152 B2
(45) Date of Patent: May 20, 2014

(54) HOT-FILL CONTAINER HAVING FLAT PANELS

(75) Inventors: Walter J. Strasser, Cement City, MI (US); Bradley S. Philip, Tecumseh, MI (US); Richard J. Steih, Jackson, MI (US); Richard K. Rangler, Tipton, MI (US); Brad Caszatt, Manchester, MI (US); John B. Simon, Springfield, MA (US)

(73) Assignee: Amcor Limited, Hawthorn (AU)

( * ) Notice: Subject to any disclaimer, the term of this patent is extended or adjusted under 35 U.S.C. 154(b) by 454 days.

(21) Appl. No.: 12/972,578

(22) Filed: Dec. 20, 2010

(65) Prior Publication Data

US 2011/0186538 A1 Aug. 4, 2011

Related U.S. Application Data

(60) Provisional application No. 61/290,588, filed on Dec. 29, 2009.

(51) Int. Cl.
*B65D 1/46* (2006.01)
*B65D 23/10* (2006.01)

(52) U.S. Cl.
USPC ..... 215/381; 215/384; 220/669; 220/672; 220/771

(58) Field of Classification Search
USPC ..... 215/381, 382, 384, 383, 398; 220/666, 220/669, 672, 675, 771
See application file for complete search history.

(56) References Cited

U.S. PATENT DOCUMENTS

| | | | | |
|---|---|---|---|---|
| 5,054,632 | A * | 10/1991 | Alberghini et al. | 215/381 |
| 5,060,453 | A * | 10/1991 | Alberghini et al. | 53/440 |
| 5,690,244 | A * | 11/1997 | Darr | 215/382 |
| D393,802 | S * | 4/1998 | Collette et al. | D9/502 |
| D393,803 | S * | 4/1998 | Walter | D9/543 |
| D396,810 | S * | 8/1998 | Riffer | D9/553 |
| 7,021,479 | B2 | 4/2006 | Pedmo et al. | |
| 7,051,892 | B1 * | 5/2006 | O'Day, Jr. | 215/383 |
| 7,080,747 | B2 | 7/2006 | Lane et al. | |
| 7,178,684 | B1 | 2/2007 | Budden et al. | |
| 7,296,701 | B2 * | 11/2007 | Ozawa et al. | 215/381 |
| 7,364,046 | B2 * | 4/2008 | Joshi et al. | 215/381 |
| D597,849 | S * | 8/2009 | Aoyagi et al. | D9/566 |
| 2001/0037992 | A1 * | 11/2001 | Tanabe et al. | 215/384 |

(Continued)

OTHER PUBLICATIONS

International Search Report and Written Opinion dated Aug. 11, 2011 from corresponding International Patent Application No. PCT/US2010/061509.

*Primary Examiner* — Sue A Weaver
(74) *Attorney, Agent, or Firm* — Harness, Dickey & Pierce, P.L.C.

(57) ABSTRACT

A container may employ an upper portion defining a mouth, a shoulder portion formed with the upper portion and extending away from the upper portion, a bottom portion forming a base, a sidewall extending between and joining the shoulder portion and the bottom portion, and a plurality of smooth surfaced vacuum panels formed in the sidewall, which may be separated by one or more strengthening grooves. The vacuum panels and/or the container in a profile view may form an hourglass shape. The container may also employ a sidewall utilizing three smooth, grooveless, vacuum panels, which may form a triangle in cross-section. The vacuum panels may be concave inward toward a central vertical axis of the container and have an hourglass shape when the container is viewed in a side view.

13 Claims, 16 Drawing Sheets

(56) References Cited

U.S. PATENT DOCUMENTS

| | | | | |
|---|---|---|---|---|
| 2002/0000421 | A1* | 1/2002 | Ota et al. | 215/381 |
| 2005/0029220 | A1* | 2/2005 | Onoda et al. | 215/382 |
| 2006/0131258 | A1* | 6/2006 | Yourist | 215/381 |
| 2006/0175284 | A1 | 8/2006 | Noll et al. | |
| 2007/0012630 | A1* | 1/2007 | Wright et al. | 210/704 |
| 2007/0039917 | A1* | 2/2007 | Yourist | 215/379 |
| 2009/0057263 | A1* | 3/2009 | Barker et al. | 215/381 |
| 2009/0159603 | A1* | 6/2009 | Lilico | 220/666 |
| 2009/0166314 | A1* | 7/2009 | Matsuoka | 215/384 |
| 2009/0294399 | A1* | 12/2009 | Pritchett, Jr. | 215/381 |

* cited by examiner

HOT-FILL CONTAINER HAVING FLAT PANELS

CROSS-REFERENCE TO RELATED APPLICATIONS

This application claims the benefit of U.S. Provisional Application No. 61/290,588, filed on Dec. 29, 2009. The entire disclosure of the above application is incorporated herein by reference.

FIELD

The present disclosure relates to a hot-fill, heat-set container with flat panels.

BACKGROUND

This section provides background information related to the present disclosure which is not necessarily prior art.

Traditionally, hot-fill plastic containers, such as polyethylene terephthalate ("PET"), have been commonplace for the packaging of liquid products, such as fruit juices and sports drinks, which must be filled into a container while the liquid is hot to provide for adequate and proper sterilization. Because these plastic containers are normally filled with a hot liquid, the product that occupies the container is commonly referred to as a "hot-fill product" or "hot-fill liquid" and the container is commonly referred to as a "hot-fill container." During filling of the container, the product is typically dispensed into the container at a temperature of at least 180° F. Immediately after filling, the container is sealed or capped, such as with a threaded cap, and as the product cools to room temperature, such as 72° F., a negative internal pressure or vacuum pressure builds within the sealed container. Although PET containers that are hot-filled have been in use for quite some time, such containers are not without their share of limitations.

One limitation of PET containers is that because such containers receive a hot-filled product and are immediately capped, the container walls contract as a vacuum pressure is created during hot-fill product cooling. Because of this product contraction, hot-fill containers may be equipped with circumferential grooves and vertical columns to aid the container in maintaining much of its as-molded shape, despite the vacuum pressure. Additionally, hot-fill containers may be equipped with vacuum panels to control the inward contraction of the container walls. The vacuum panels are typically located in specific wall areas immediately beside vertical columns and immediately beside circumferential grooves so that the grooves and columns may provide support to the moving, collapsing vacuum panels yet maintain the overall shape of the container.

Hot-fill containers may be molded in a preferred shape, such as a cylindrical shape with a circular cross-section such that any internal vacuum pressure created during the cooling of the hot-fill liquid may equally affect the circular wall. As a result of such cooling, hot-fill containers typically experience a degree of container wall movement that is only mildly detectable to the human eye. In other words, because of the specific, strategic location of a limited number of vacuum panels that account for nearly all vacuum absorption of the container, hot-fill containers may typically maintain their overall shape with no appreciable change in appearance. A limitation of current containers lies in maintaining the general container shape yet permitting controlled deformation of the container during cooling to maintain the overall shape of the container.

What is needed then is a hot-fill container that is capable, upon cooling, of forming into unique and freeform shapes that absorb, in a controlled manner, internal vacuums to a degree and that also generally maintain the overall cylindrical shape of the container.

SUMMARY

This section provides a general summary of the disclosure, and is not a comprehensive disclosure of its full scope or all of its features.

A container may utilize or employ, as a plastic molded unit, an upper portion defining a mouth, a shoulder portion formed with the upper portion and extending away from the upper portion, a bottom portion forming a container base with a contact ring, a sidewall extending between and joining the shoulder portion and the bottom portion, and a plurality of smooth vacuum panels formed in the sidewall. The vacuum panels are separated by one or more strengthening grooves to create panels. The strengthening groove is continuous and circular around the container periphery or circumference. The smooth vacuum panels are grooveless in that there are no interruptions in the surface of the vacuum panels. Interruptions may be vacuum initiators or grooves that begin and end in the surface of the panel. The smooth vacuum panels may be separated by a plurality of continuous circular grooves that provide a hand gripping area of smaller panels, compared to the panels. The container in a profile view, such as when viewed along a sight line coincident with the horizontal centerline, forms an hourglass shape to a viewer.

The plurality of circular grooves may be at a plurality of different depths relative to the same panel in the container sidewall, and be molded in the periphery or circumference of the container. The vacuum panels in cross-section may form four semi-circular sections that together form the container sidewall, as in FIGS. 3 and 4. The continuous grooves in cross-section, between the vacuum panels, form a circle with a cross-sectional area smaller than a cross-sectional area formed by the enclosed container wall of the vacuum panels.

In another embodiment, a container may employ or utilize an upper portion defining a mouth, a shoulder portion formed with the upper portion and extending away from the upper portion, a bottom portion forming a base, and a sidewall extending between and joining the shoulder portion and the bottom portion such that the sidewall has at least one smooth, grooveless, vacuum panel. A smooth, grooveless vacuum panel is one in which the surface of the panel itself has no grooves, such as a vacuum initiator, in it although vacuum panels themselves may be separated by grooves. The sidewall may further employ three smooth, grooveless, vacuum panels that may form a triangle when the container body is viewed in cross-section. Still yet the vacuum panels may be concave inward toward a central vertical axis such that the center portion of the panel is the closest part of the panel to the central vertical axis. The top longitudinal end of the panel and the bottom longitudinal end of the panel may be equidistantly farthest from the central vertical axis, with regard to the panel. The vacuum panels may have an hourglass shape when the container is viewed in a side view, such as coincident with a central horizontal axis. The shoulder portion and the base portion, to which the vacuum panels are molded, may be coincident, regarding their outer perimeters for example, when viewing the container from the top or bottom.

Further areas of applicability will become apparent from the description provided herein. The description and specific examples in this summary are intended for purposes of illustration only and are not intended to limit the scope of the present disclosure.

DRAWINGS

The drawings described herein are depicted "to scale" vis-à-vis the actual, physical embodiments but are not intended to limit the scope of the present disclosure in any way.

DETAILED DESCRIPTION

Figure 1:
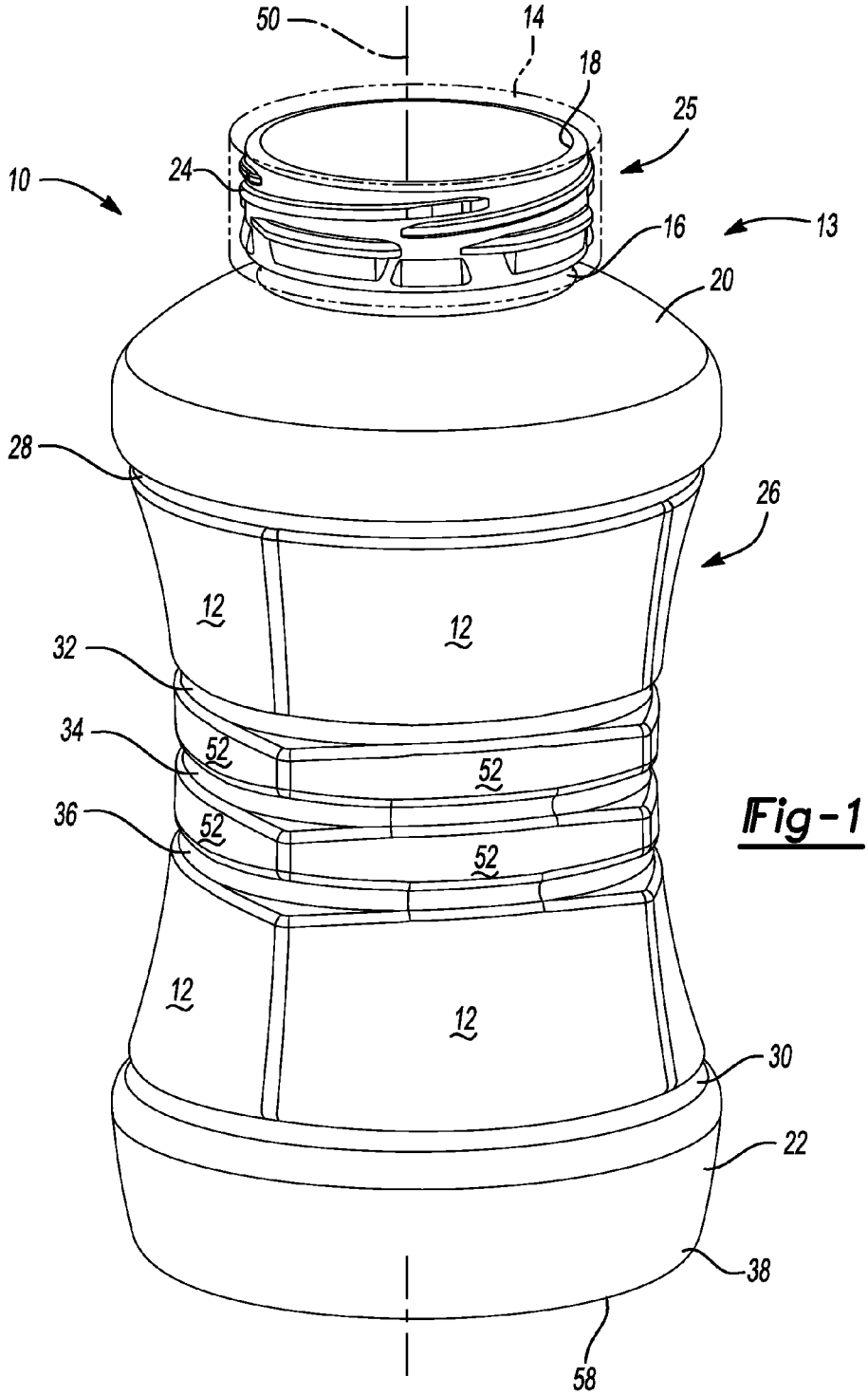
FIG. 1 is a perspective view of a first embodiment of a hot-fill container depicting numerous flat wall panels.

The following description is merely exemplary in nature and is not intended to limit the present disclosure, application, or uses. It should be understood that throughout the drawings, corresponding reference numerals indicate like or corresponding parts and features.

Turning now to FIGS. 1-17, details of the embodiments of the present teachings will be presented. More specifically, FIG. 1 depicts a perspective view of a first embodiment of a hot-fill, blow molded plastic container 10 that exemplifies principles and structure of the present invention. The internal volume of the container 10 is designed to be filled with a product, typically a liquid such as a fruit juice or sports drink, while the product is in a hot state, such as at or above 180° F. After filling, the container 10 is sealed, such as with a cap 14 and cooled. During cooling, the volume of the product in the container 10 decreases which in turn results in a decreased pressure, or vacuum, within the container 10. While designed for use in hot-fill applications, it is noted that the container 10 is also acceptable for use in non-hot-fill applications.

Since the container 10 is designed for "hot-fill" applications, the container 10 is manufactured out of a plastic material, such as polyethylene terephthalate ("PET"), and is heat set ("HS") enabling such that the container 10 is able to withstand the entire hot-fill procedure without undergoing uncontrolled or unconstrained distortions. Such distortions may result from either or both of the temperature and pressure during the initial hot-filling operation or the subsequent partial evacuation of the container's interior as a result of cooling of the product. During the hot-fill process, the product may be, for example, heated to a temperature of about 180° F. or above and dispensed into the already formed container 10 at these elevated temperatures.

As depicted in at least FIG. 1, the container 10 generally includes an upper portion 13 having a neck 16 and defining a mouth 18, a shoulder portion 20, and a bottom portion 22. As depicted, the shoulder portion 20 and the bottom portion 22 are substantially annular or circular in cross-section. The cap 14 engages threads 24 on a finish 25 to close and seal the mouth 18. The neck 16 lies below the finish 25.

Extending between the shoulder portion 20 and the bottom portion 22 is a sidewall or body 26 of the container 10. As depicted in FIG. 1, the body 26 has a variety of cross-sectional shapes. Near the transition between the shoulder portion 20 and the sidewall or body 26 is a rib or groove 28, which provides sidewall strength to the container 10 and which is generally circular. A corresponding rib or groove 30 may be located between the body 26 and bottom portion 22. The grooves 28, 30 with their positions near the top and bottom of the container 10, assist in maintaining the overall cylindrical shape of the container 10. Within and throughout the body 26 between the shoulder portion 20 and the bottom portion 22, the cross-sectional and sidewall shapes vary due to employment of flat wall panels 12 and additional strengthening grooves 32, 34, 36 within the midst of such flat wall panels 12 and the sidewall or body 26. On the inside of the container 10, the grooves 32, 34, 36 form a rib, which strengthens the body 26, also known as a sidewall.

Before continuing with a description of the container body 26, a brief description of the shoulder portion 20 and bottom portion 22 will be provided. The container shoulder portion 20 is generally of a conical shape with a narrower cross section that joins or forms into the neck 16 while the opposite end of the shoulder portion 20 has a larger cross section and meets with the body 26, with groove 28 disposed therebetween as part of the transition. The bottom portion 22 of the container 10 may have a chime 38 located between a container bottom contact ring 58, which contacts a surface upon which the container rests, and a bottom groove 30.

Figure 2:
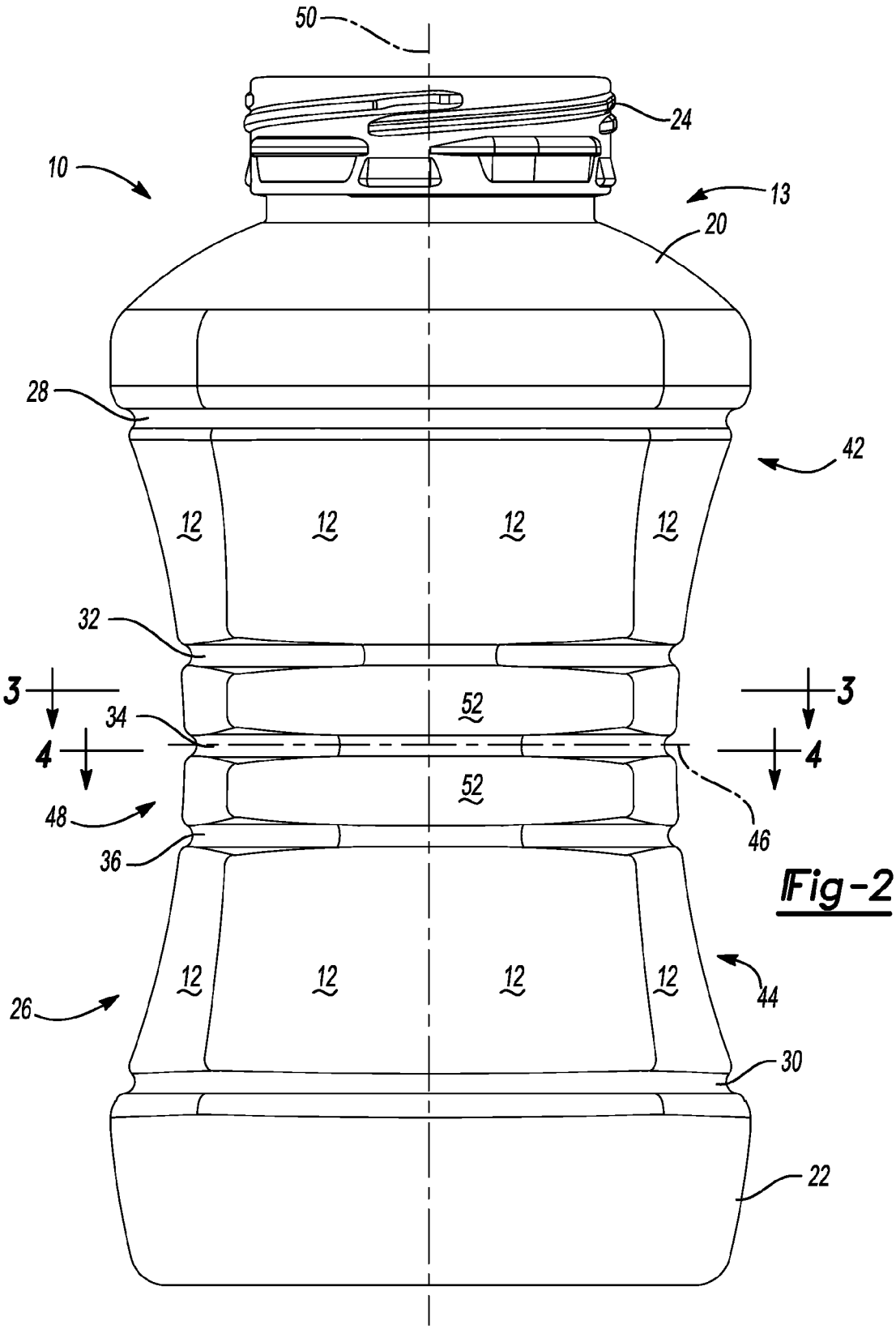
FIG. 2 is a side view of the hot-fill container of FIG. 1 depicting the container sidewall.

The embodiment of the container depicted in FIGS. 1-7 may employ multiple flat panels 12 in its body 26, which will now be discussed. Turning to FIG. 2, the container 10 depicts numerous flat panels 12, with a top group of flat panels 42 above a horizontal centerline 46 of the container 10 and a bottom group of flat panels 44 below a horizontal centerline 46 of the container 10. The flat panels 12 in the body 26 have the utility of absorbing internal vacuum within the container during container product cooling. The grooves 32, 34, 36 serve the purpose of resisting sidewall deformation and adding strength to the midsection 48, which is a hand gripping area, of the container 10 so that a user may grasp and hold the container 10 without deformation in the sidewall as the cap 14 is removed which may result in outward expansion of the container body 26. Contraction of the container body 26 generally results in body movement toward a central vertical axis 50, while expansion of the container body 26 generally results in body movement away from the central vertical axis 50.

More specifically, the container 10 may employ numerous flat wall panels 12 as part of the upper group of flat panels 42 and the lower group of flat panels 44 to absorb and displace liquid during internal volume decreases due to hot-fill product cooling. The panels 12 may be defined by a combination of grooves 32, 34, 36 and/or variations in the container profiles, such as a concavity or convexity. The size, shape and location of the panels 12 may determine the method and extent of deformation as the panels 12 absorb the internal vacuum. For instance, larger panels may undergo more drastic deformation, as may be the case for portions of the panels at the farthest or most distant portion from a rib or more rigid structure. The deflective action or extent of the panel 12 may further be controlled by varying the convexity and/or concavity of the surface of the panel, both vertically and horizontally, along with the wall thickness of the panel 12. The location of the panels 12 may also help in determining the wall thickness of the panel. For instance, panels placed on relatively larger cross-sectional areas and closer to the horizontal centerline 46 of the container 10 tend to have less average material thickness and be more flexible. Larger panels will be described later in conjunction with another embodiment. The grooves, profiles and/or cross-sections that surround the panels 12 act as reinforcements to provide strength to the container 10 so that the container 10 maintains its basic shape and achieves other performance requirements.

Continuing with FIGS. 1-7, the container 10 may incorporate two or more relatively flat panels 12 and result in generally polygonal cross-sectional shapes. The container 10 may have an hourglass appearance when viewed in a side view from any side of the container. To provide an hourglass appearance, the panels 12 may vary in width such that the panels near or proximate the horizontal centerline 46 may be smaller, as is evident with panels 52 in FIGS. 1 and 2. The structural design or shape of the flat panels directly affects how responsive the panel will be to an internal vacuum. That is, the degree or amount of panel movement toward the central vertical axis 50 directly depends upon the degree of flatness of the panels 12, 52. More specifically, if a panel is not completely flat, but is either concave inward or concave outward, the panel may be resistant to movement. In other words, the closer to "flat" or flatter that a panel is initially, upon container formation, the more responsive it will be to small movements due to internal vacuum. Because a flat panel represents the shortest distance between two points, such as points at the perimeter of the panel, the supporting surfaces must be flexible enough to allow the panel to buckle inward in order for it to absorb or respond to a large vacuum pressure.

Figure 3:
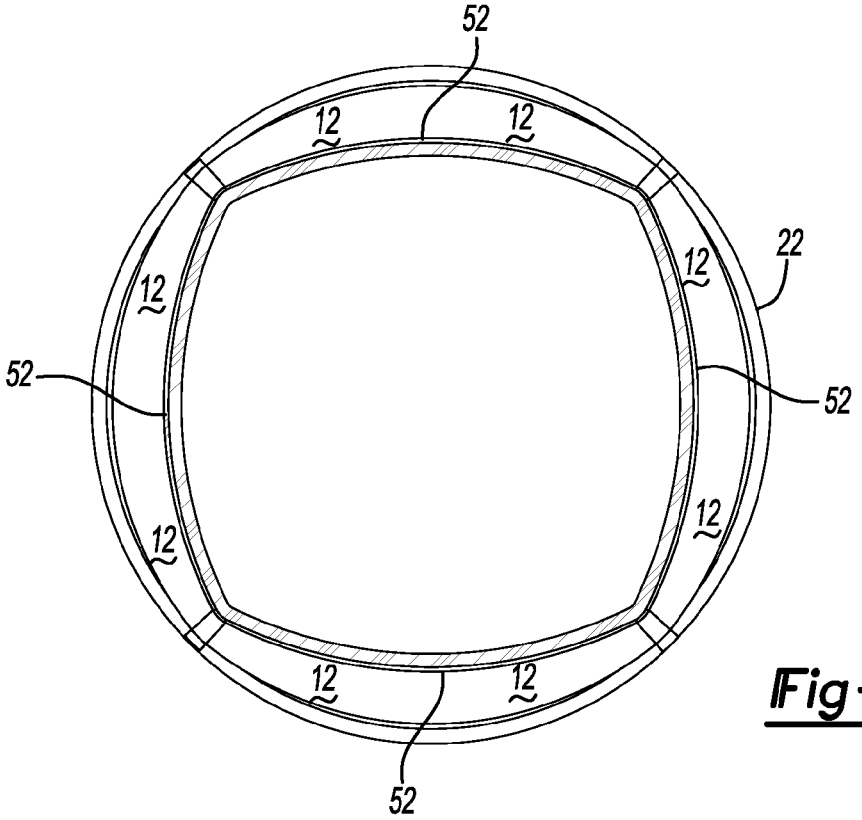
FIG. 3 is a view from the strengthening grooves at line 3-3 of FIG. 2.
Figure 4:
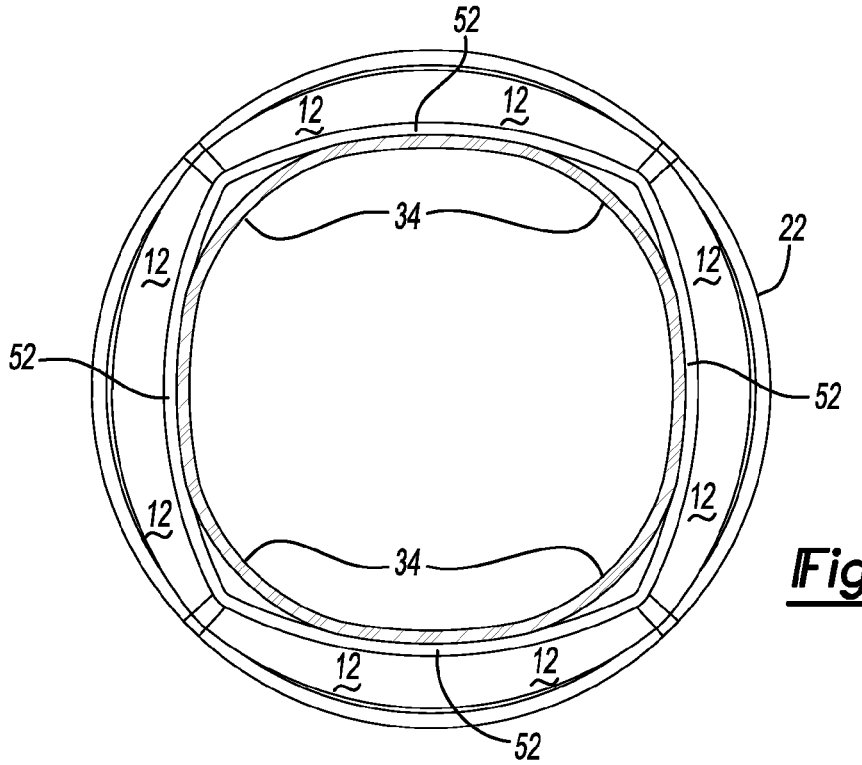
FIG. 4 is a view from the strengthening grooves at line 4-4 of FIG. 2.

Turning now to FIGS. 3 and 4, additional views of the container 10 of FIG. 2 will be presented. FIG. 3 is a view from line 3-3 in FIG. 2 and FIG. 4 is a view from line 4-4 in FIG. 2. Regarding FIG. 3, from the vantage point of line 3-3, the bottom portion 22 of the container 10 forms the outermost periphery of the container 10 while the panels 52 form the innermost boundary. Together, the panels 12, 52 and the grooves 32, 34, 36 form an hourglass figure in container 10. With the vantage point from line 4-4 in FIG. 2, FIG. 4 reveals the groove 34 relative to panels 52 and panels 12. It is the groove 34, the groove 32 and the groove 36, that provide strength to the central section of the container, that is, that portion of the container that has the grooves 32, 34, 36 and panels 52, so that the container 10 may be gripped by a human hand without buckling or collapsing.

Figure 5:
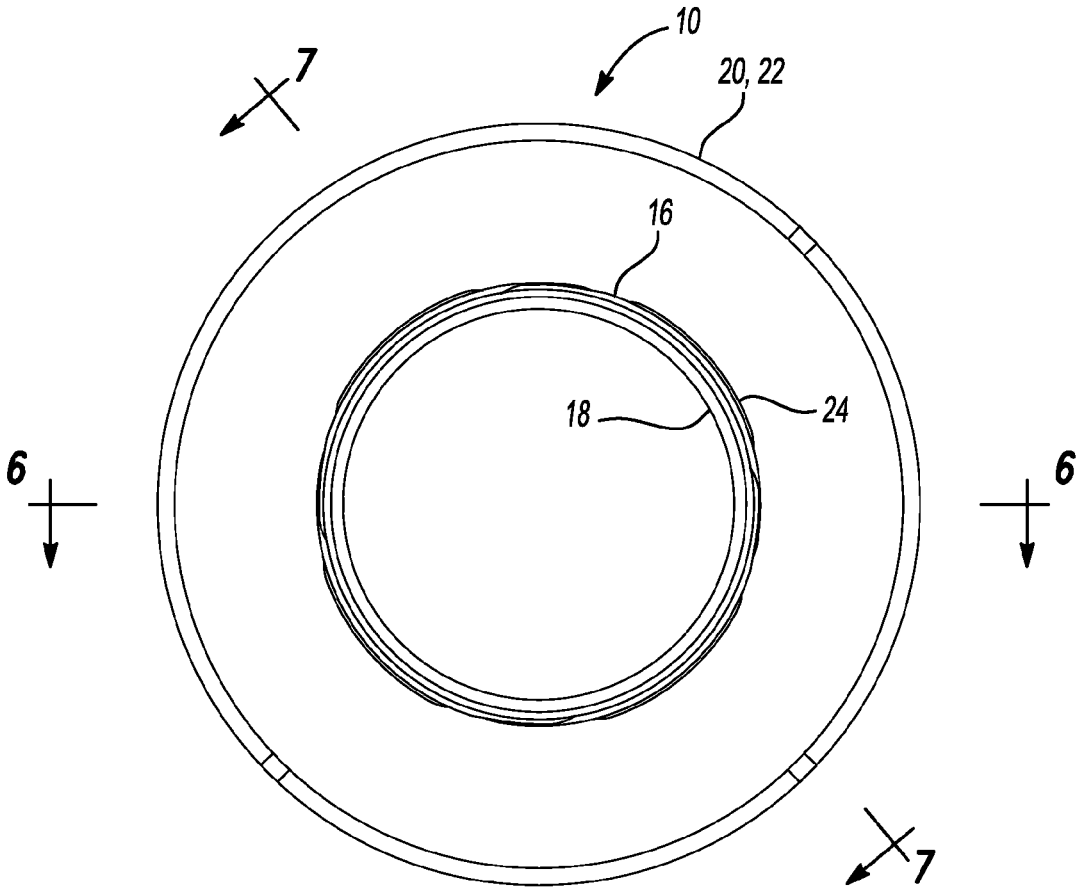
FIG. 5 is a top view of the hot-fill container of FIG. 1.
Figure 6:
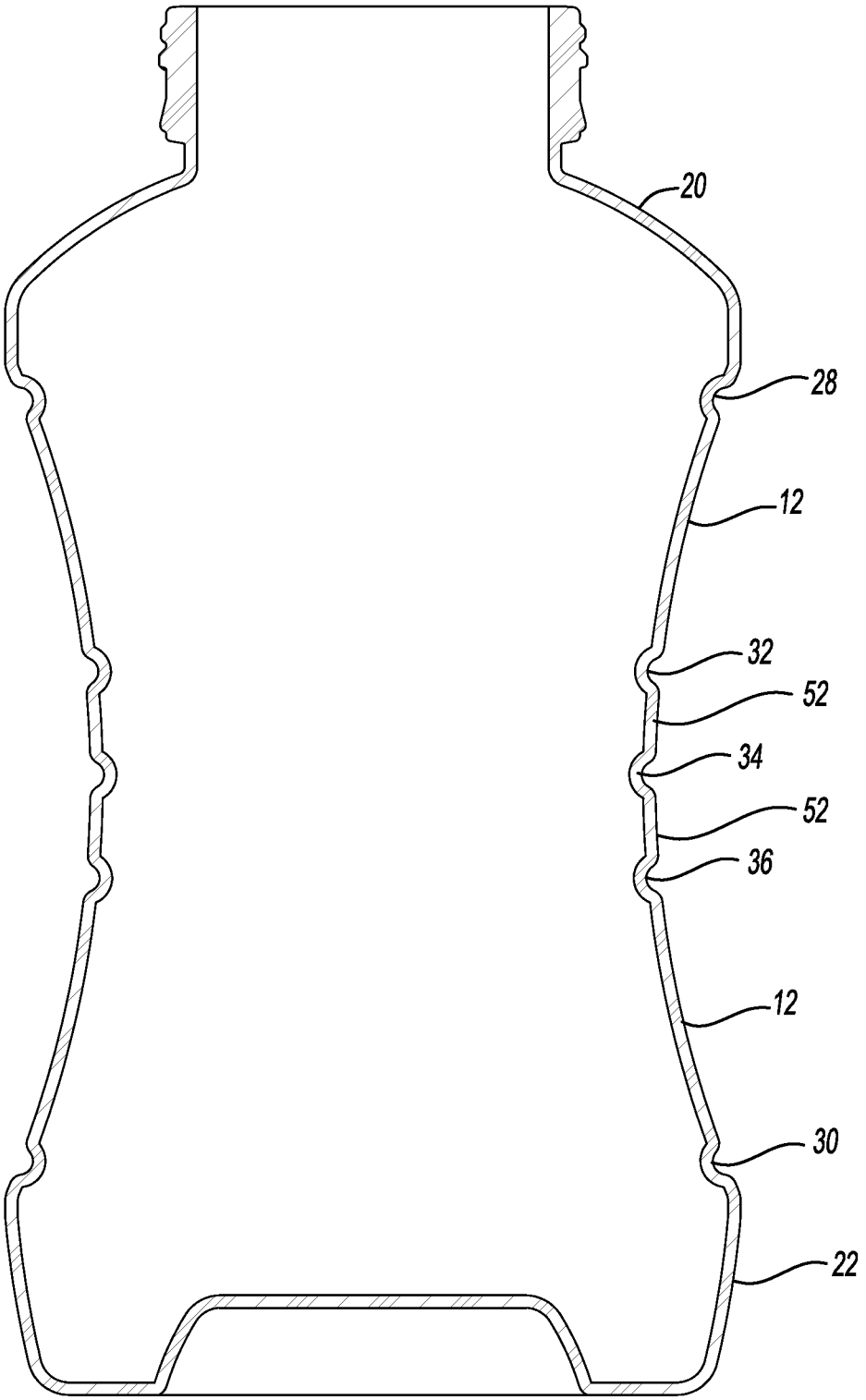
FIG. 6 is a view of the hot fill container of FIG. 1, at line 6-6 of FIG. 5.
Figure 7:
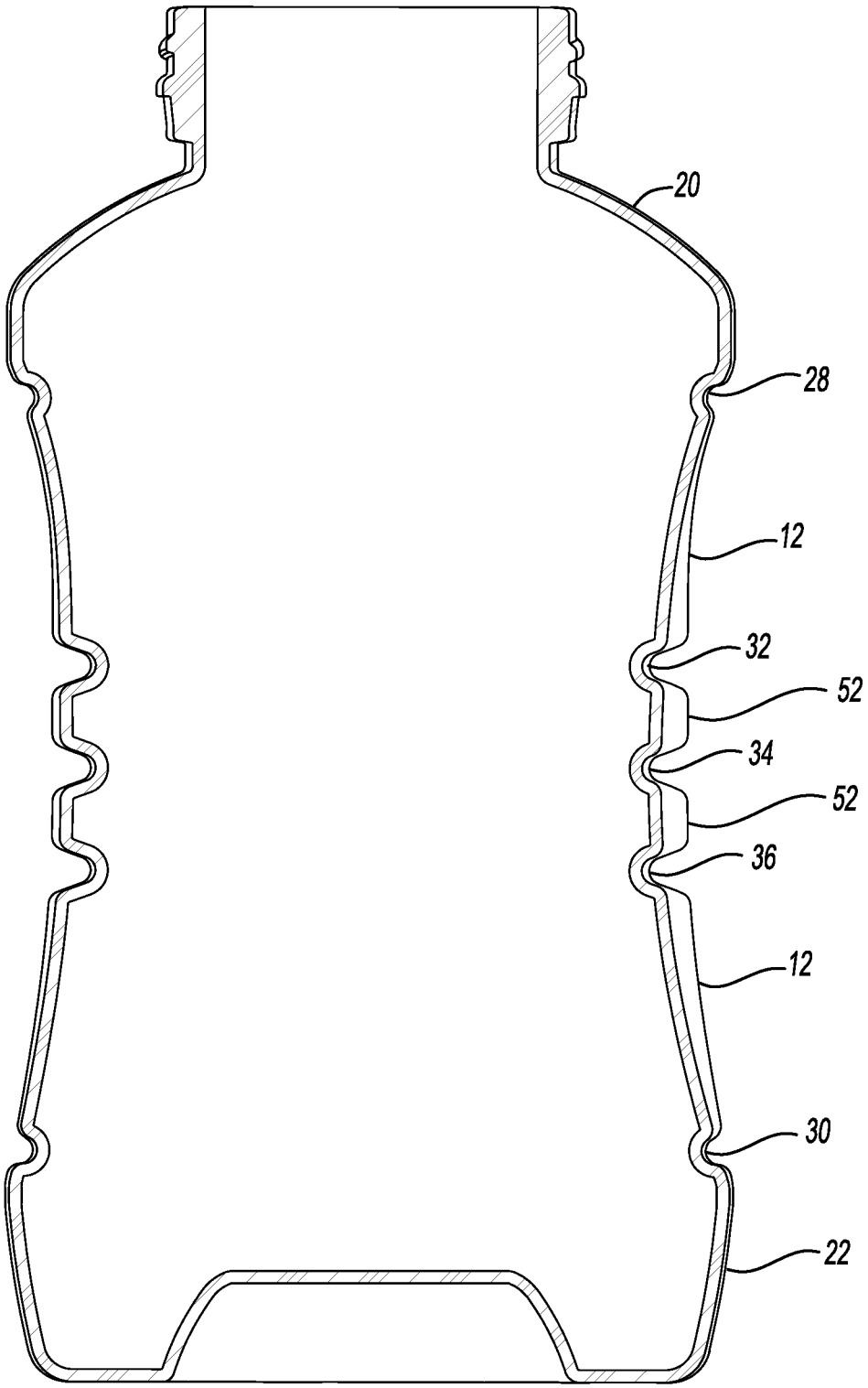
FIG. 7 is a view of the hot fill container of FIG. 1, at line 7-7 of FIG. 5.

Turning now to FIGS. 5-7 additional views of the container 10 will be presented. FIG. 5 is a top view of the hot-fill container of FIG. 1, FIG. 6 is a view of the hot-fill container of FIG. 1 at line 6-6 of FIG. 5, and FIG. 7 is a view of the hot-fill container of FIG. 1 at line 7-7 of FIG. 5. More specifically, FIG. 5 depicts a top view of the container 10 of FIG. 1 with section line 6-6 passing through a vertical plane of the container 10 where the grooves 32, 34, 36 are the most shallow. That is, the section line 6-6 passes through the container where the valleys of the grooves 32, 34, 36 are closest to the outer surface of the container 10, and more specifically, the valleys of the grooves 32, 34, 36 are closest to the outer surface of the panels 12, 52.

The section view of FIG. 6 may be contrasted with that of FIG. 7. More specifically, the section line 7-7 passes through a vertical plane of the container 10 that is rotated relative to the vertical plane 6-6 of FIG. 6. Continuing, the vertical plane passes through the neck 16, the shoulder portion 20 and the bottom portion 22 of the container in FIG. 7 at a container location such that the valleys of the grooves 32, 34, 36 are farthest from the outer surface of the panels 12, 52 relative to that disclosed in FIG. 6. An advantage of varying the structure of the panels 12, 52 so that they are each oriented nearly flat, thus forming nearly a square as depicted in FIGS. 3 and 4, is that the strength of the middle section, which is the gripping section, of the container 10 is maintained and not subject to deformation by an internal vacuum pressure or release of an internal vacuum pressure, which may occur when opening the container 10. Because the moment of inertia of the grooves 32, 34, 36 and their adjacent walls is larger than any moment of inertia that the panels 12, 52 may provide, the panels may yield to the internal vacuum pressure. More specifically, the panels 12, 52 may yield inwardly toward the central vertical axis 50 when subjected to a vacuum pressure and move outwardly when such vacuum pressure is released upon removal of the cap 14.

Figure 8:
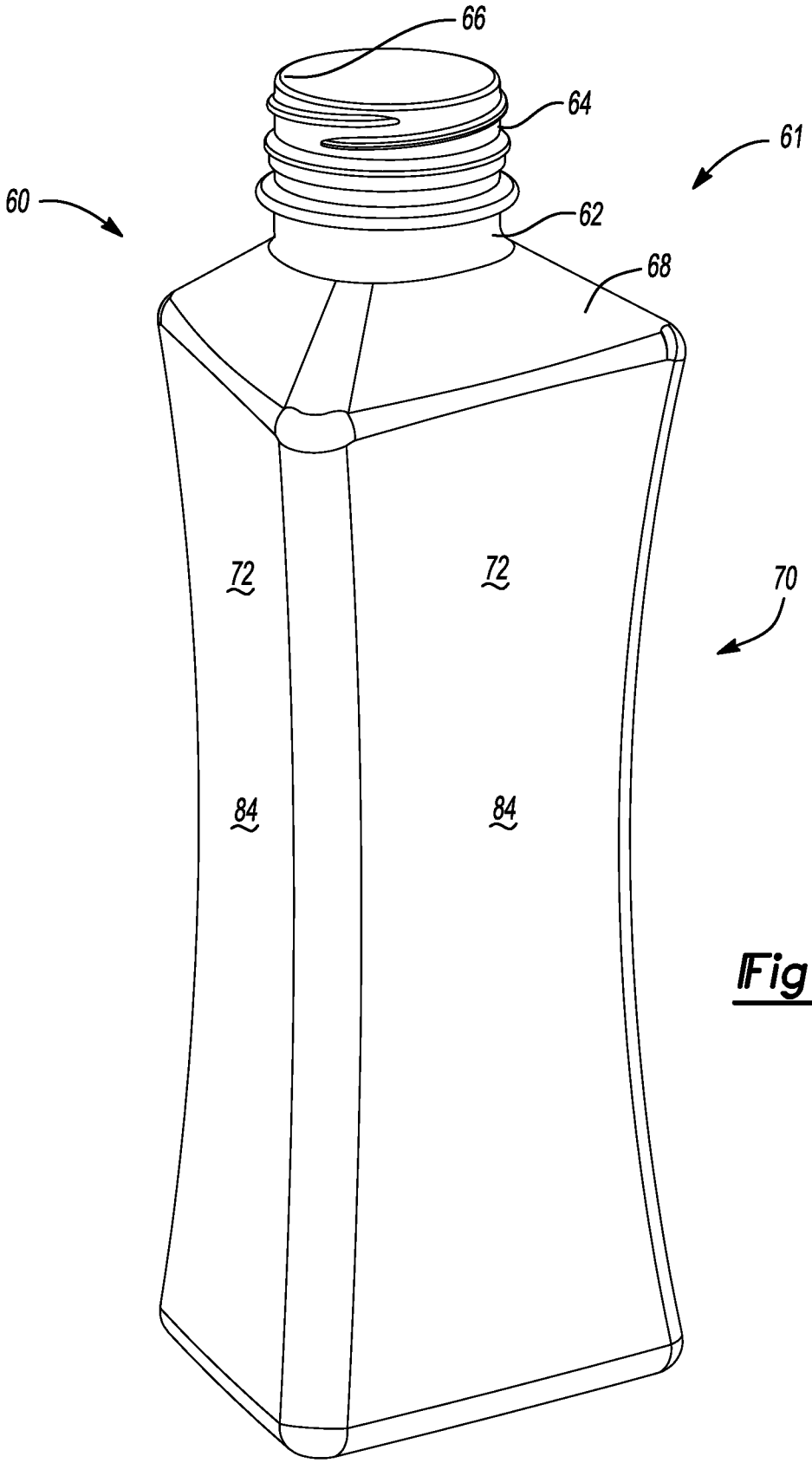
FIG. 8 is a perspective view of a second embodiment of a hot-fill container depicting flat wall panels.
Figure 9:
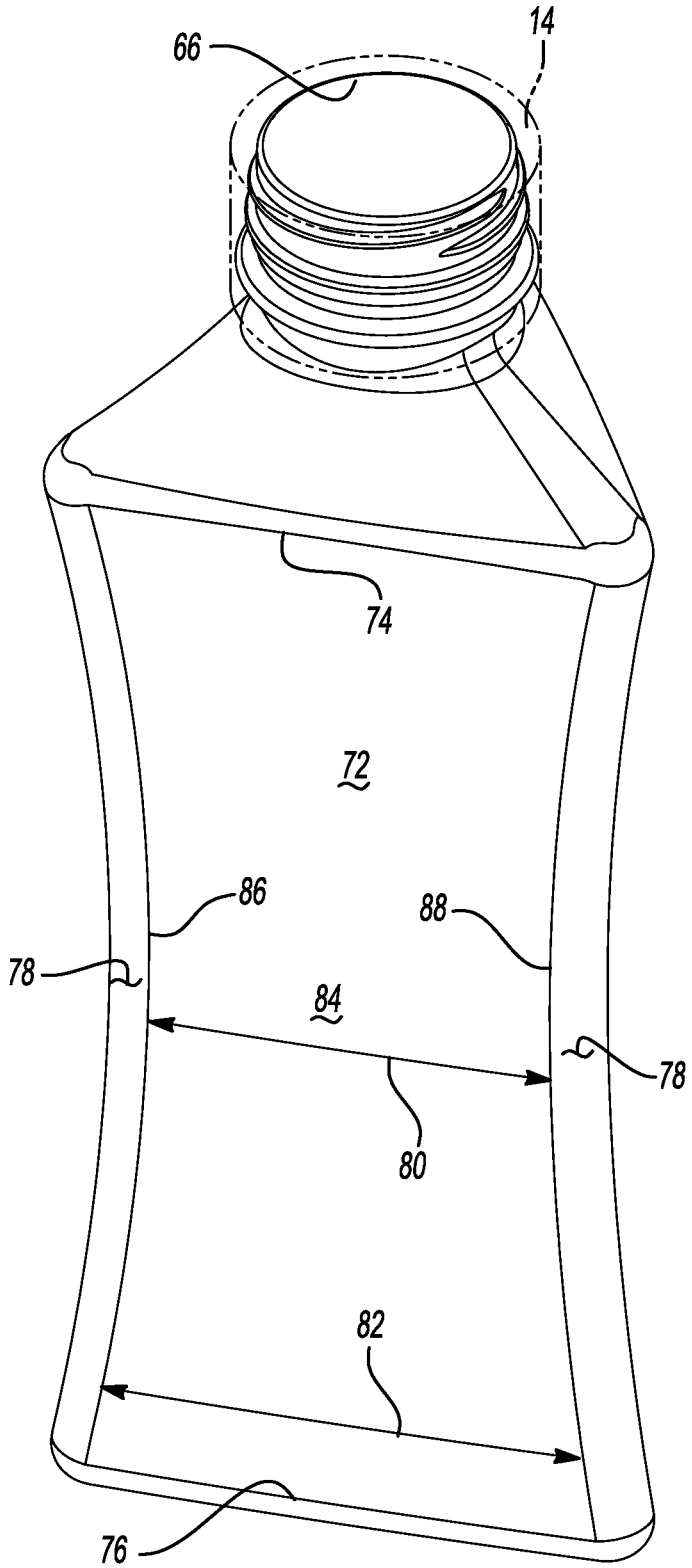
FIG. 9 is a perspective view of the hot-fill container of FIG. 8 depicting one large flat panel as a sidewall.
Figure 10:
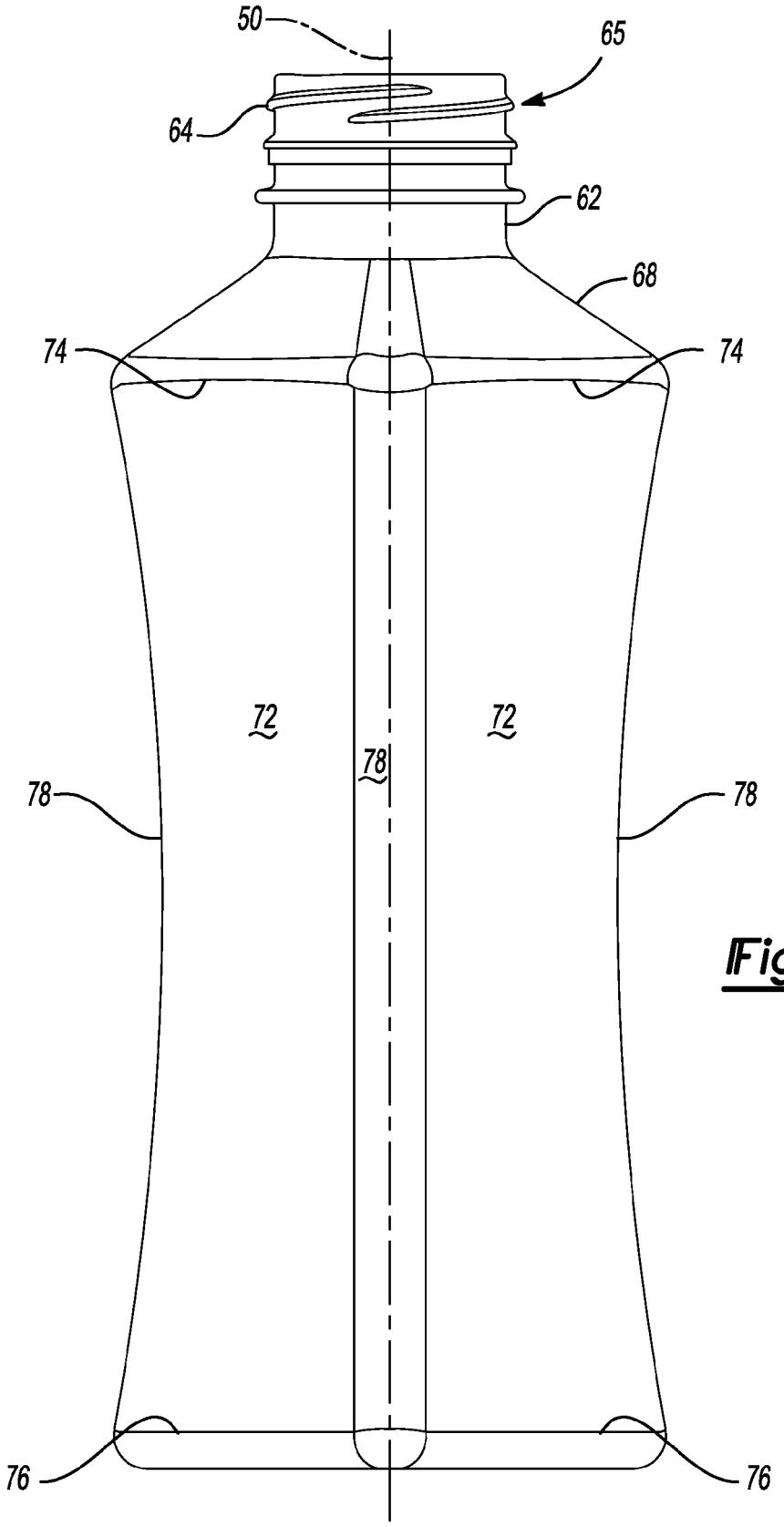
FIG. 10 is a side view of the hot-fill container of FIG. 8 depicting the juncture of two large flat panel sidewalls.
Figure 11:
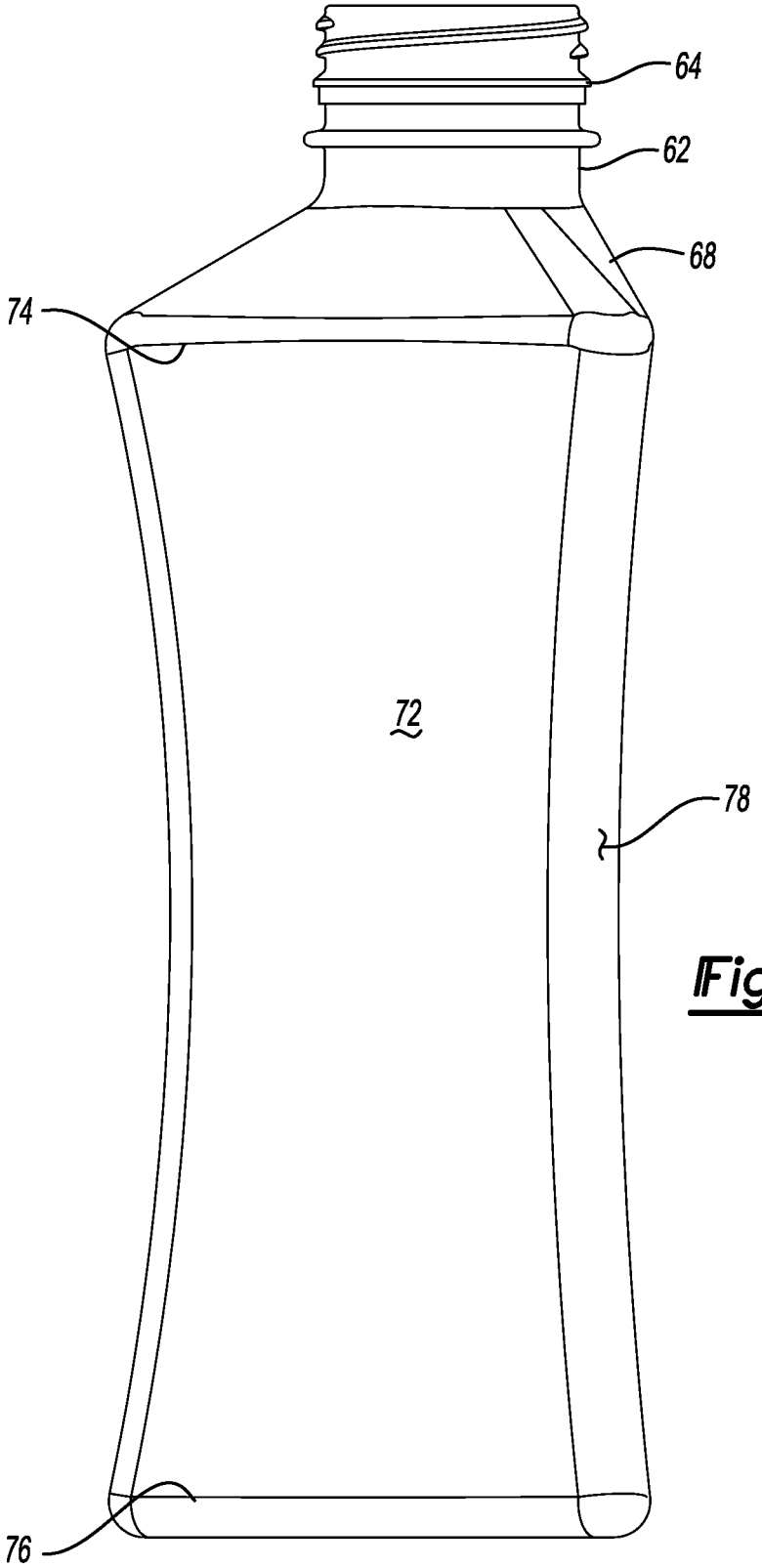
FIG. 11 is a side view of the hot-fill container of FIG. 8 depicting one large flat panel as a sidewall.

Turning now to FIGS. 8-17, another embodiment of the invention will be described. FIG. 8 depicts a container 60 whose cross-section is generally triangular in shape, as will be described later. The container 60 has an upper portion 61 including a neck 62 and a finish 65, which defines threads 64, and an opening 66. As a single, molded container 60, the neck 62 lies next to and is formed with a shoulder portion 68 that lies next to a sidewall or body 70, which employs multiple panels 72, which may be large flat panels, which may only be supported about their perimeter with no grooves providing intermediary structural support to the panel 72. Continuing with FIG. 8 and also FIGS. 9-11, the container 60 may have an outward appearance that is triangular in shape. More specifically, the container 60 may employ three relative large panels 72 that may be concave inward toward a central vertical axis 50. That is, the center of each panel 72 may be closer to the central vertical axis 50 than either of a top longitudinal end 74 or a bottom longitudinal end 76 of the panels 72. The longitudinal periphery of each of the panels 72 meets a panel 72 next to it and forms a juncture or longitudinal edge 78, which may be concave inward toward the central vertical axis 50, as depicted in FIG. 10. An advantage of such large panels 72 in the container 60 is that the panels will move inwardly, toward the central vertical axis 50 much more than a smaller panel, thus permitting larger amounts of liquid within the container 60 to be displaced during cooling of a hot-fill product after filling and capping of the container 60. The panels 72 of the container 60 may be formed as concave inward panels whose center sections are closer to the central vertical axis 50 than the perimeter portions of the panels, both before filling and upon cooling of the hot-fill product.

Figure 12:
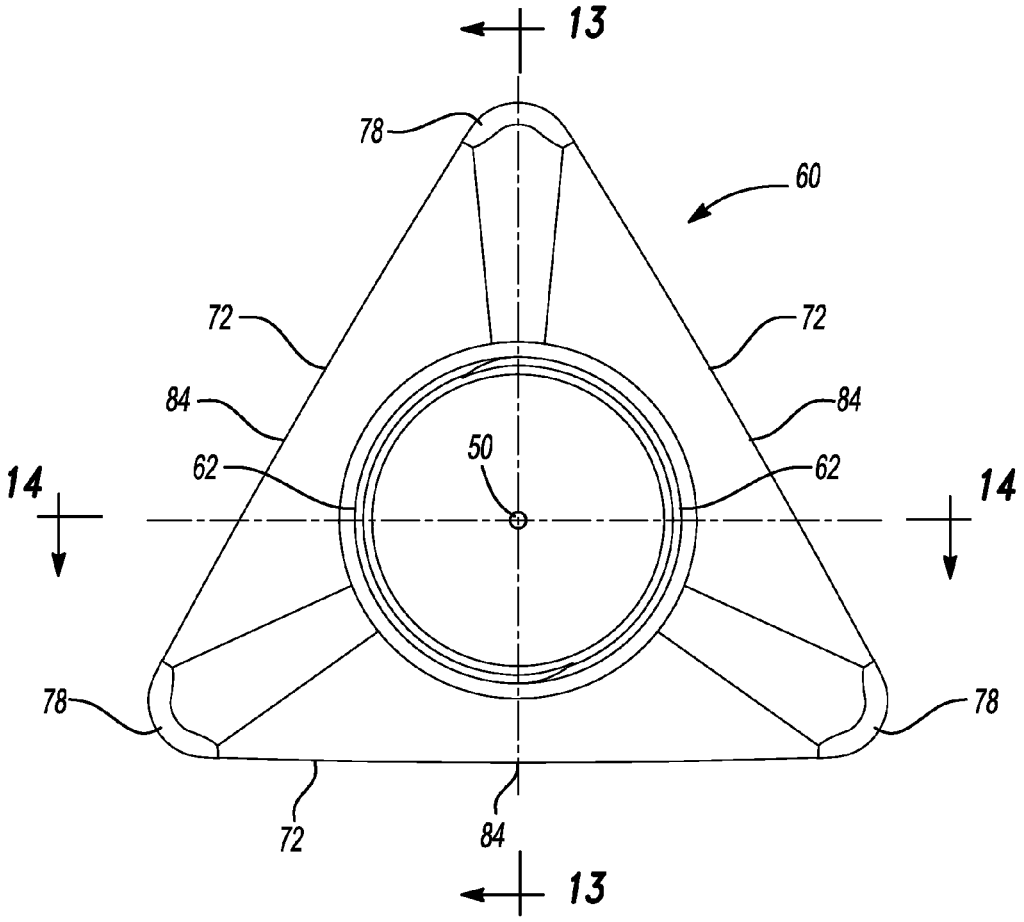
FIG. 12 is a top view of the hot-fill container of FIG. 8.
Figure 13:
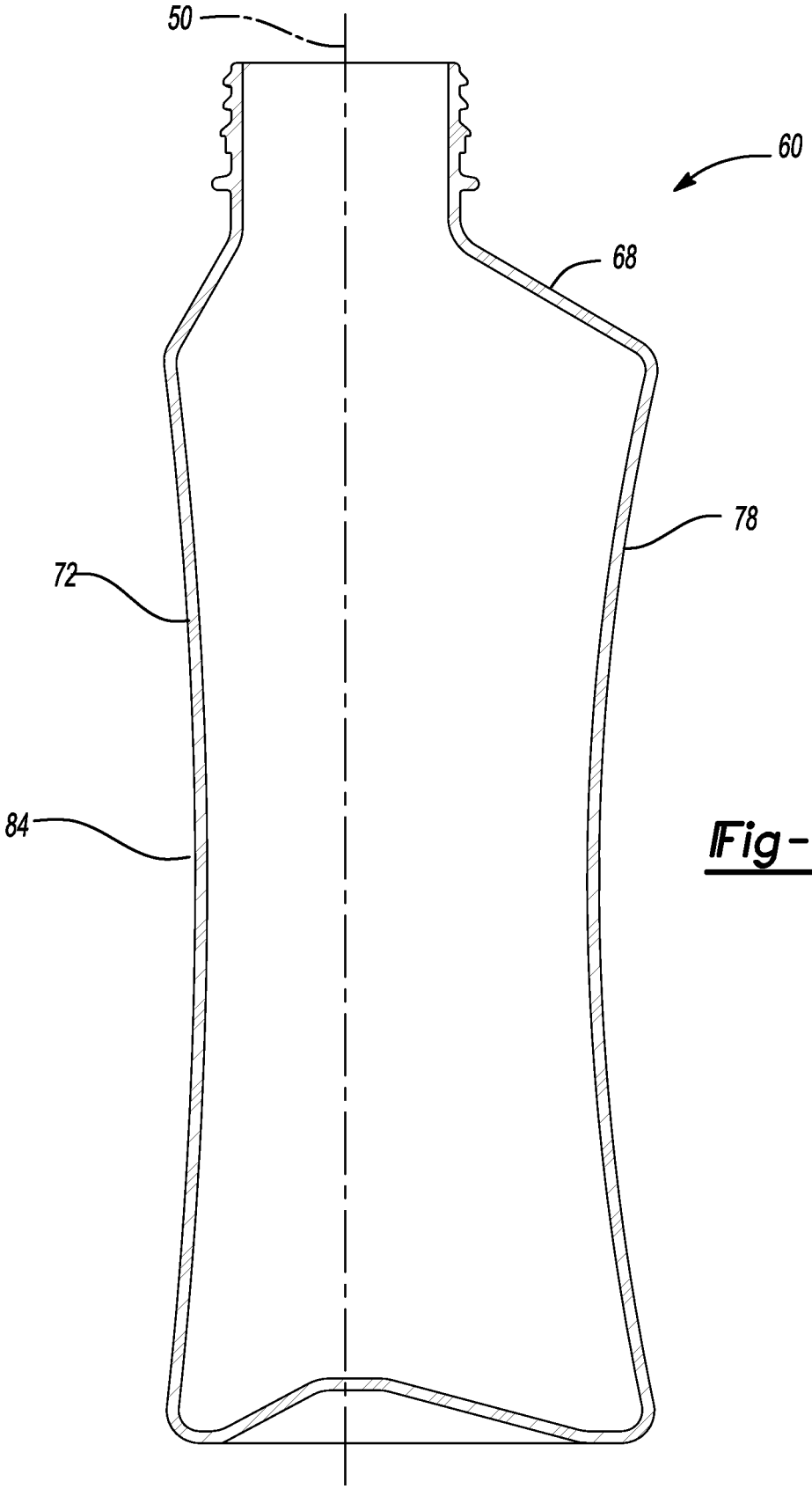
FIG. 13 is a view of the hot-fill container of FIG. 8 at line 13-13 of FIG. 12.
Figure 14:
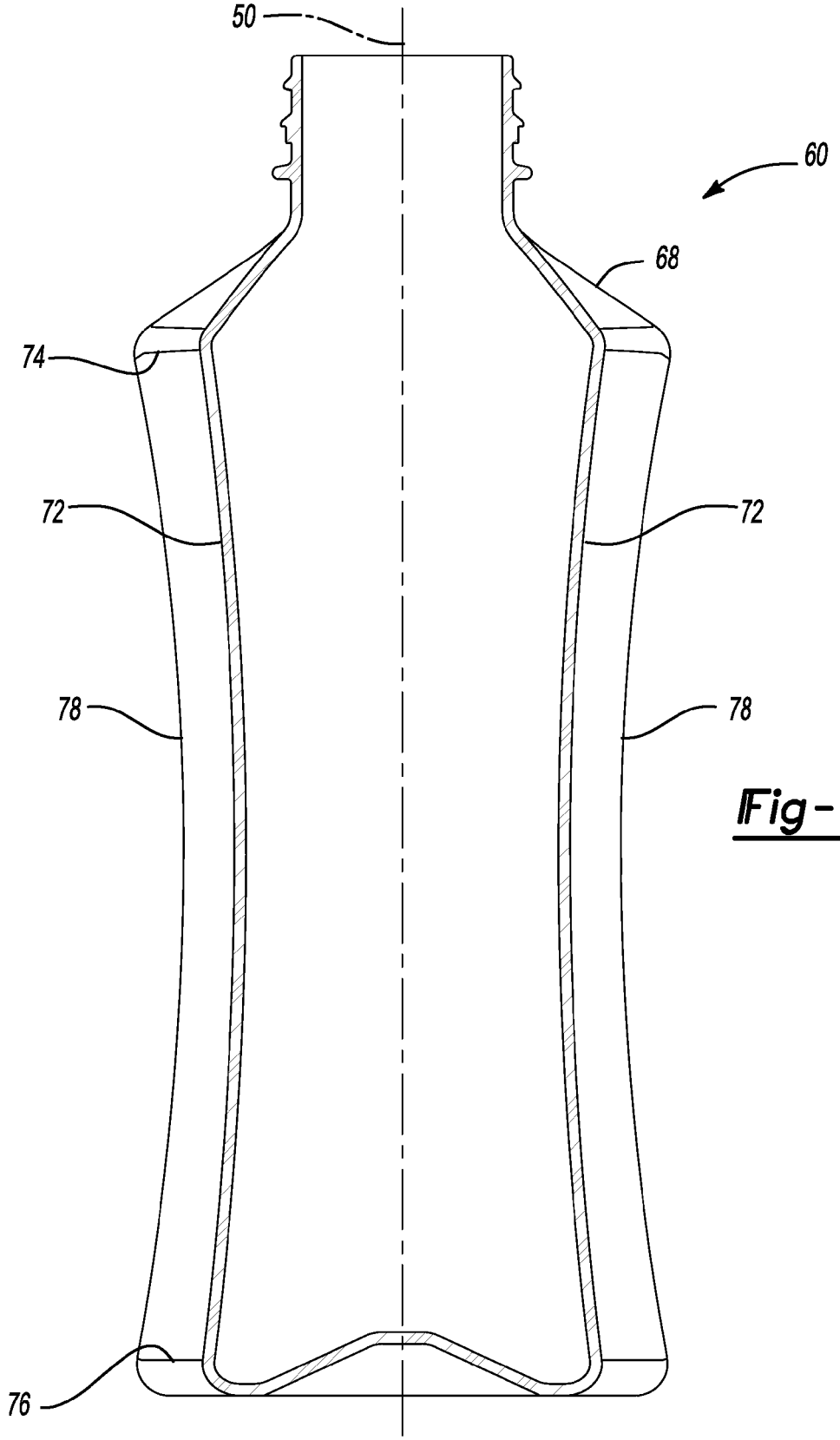
FIG. 14 is a view of the hot-fill container of FIG. 8 at line 14-14 of FIG. 12.

Turning now to FIGS. 12-14, further aspects of the second embodiment of the invention will be presented. FIG. 12 is a top view of the hot-fill container of FIG. 8, and depicts section lines 13-13 and 14-14, which correspond to respective FIGS. 13 and 14. As depicted, the container 60 is generally triangular in shape with three panels 72. An individual panel 72 may meet another individual panel 72 to form an edge 78, which itself may be concave inward along with the panels 72. FIG. 13 depicts the view of a vertical plane at line 13-13 of FIG. 12 and depicts a panel 72 and an edge 78. As FIG. 13 depicts the edge 78 may be concave inward toward the central vertical axis 50 to a greater extent than the panel 72. Such may be the case because the panels 72 themselves may be formed in the shape of an hour glass, with a center section 80 that is not as wide as the end portions of the panel 72, as depicted in FIG. 9. More specifically, the dimension of the center section 80 is less than a dimension 82 of the bottom longitudinal end 76, which may be the same as the top longitudinal end 74.

FIG. 14 is a view of the hot-fill container 60 of FIG. 8 at line 14-14 of FIG. 12. More specifically, the view depicted in FIG. 14 is through two panels 72 and the central vertical axis 50 of the container 60 of FIG. 12. FIG. 14 depicts the concave inward structure of the panels 72 and edges 78, which may be concave inward before hot-filling, that is upon container 60 manufacture, and to a further degree after capping the container 60 and upon cooling of the hot-fill liquid within the container 60. Due to the angle with which the shoulder portion 68 and the panel 72 meet, the top longitudinal end 74 and the bottom longitudinal end 76 do not deform or move during movement of the central section 84 of the panel 72. Because the panel 72 is not supported except about its periphery, the deflection in the central section 84 of the panel 72 is greatest at the longitudinal and transverse center of the panel 72. The deflection toward the central vertical axis 50 becomes less and less at each position closer to the periphery of the panel 72, that is, closer to each of a longitudinal end 74, 76 or a transverse end 86, 88.

Figure 15:
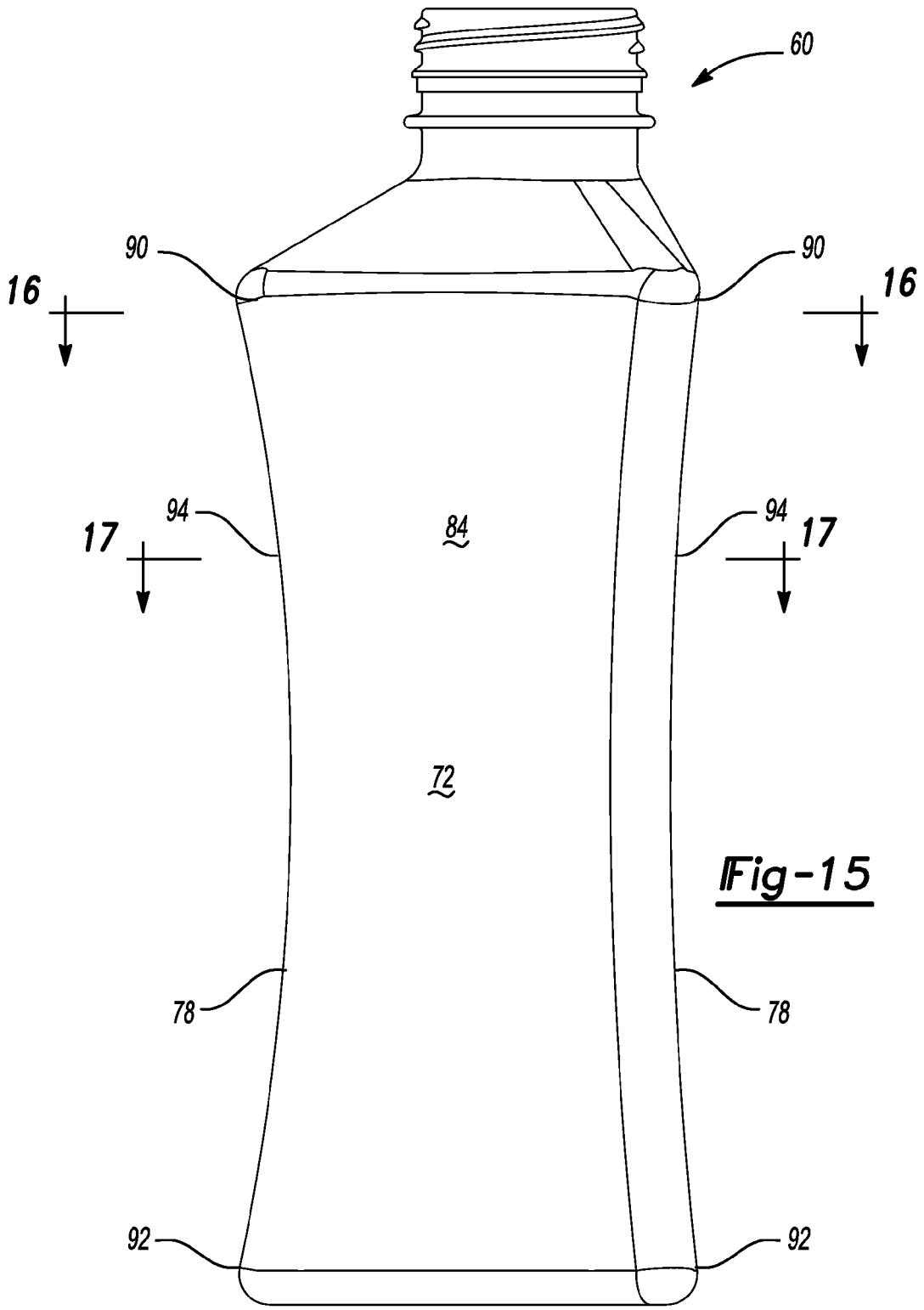
FIG. 15 is a side view of the hot-fill container of FIG. 8, depicting the origin of specific container views.
Figure 16:
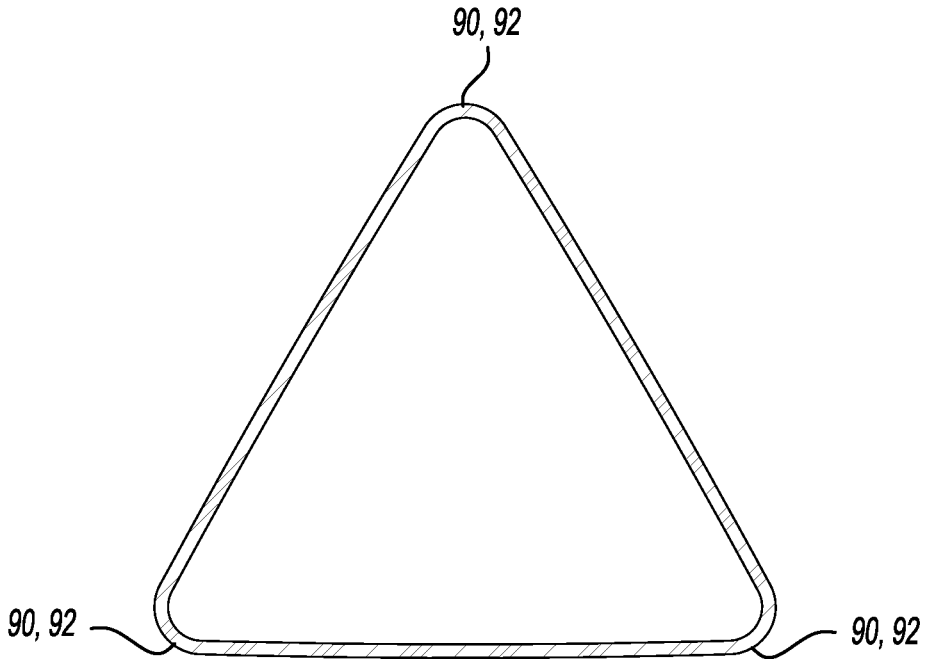
FIG. 16 is a view of the hot-fill container of FIG. 8 at line 16-16 of FIG. 15.
Figure 17:
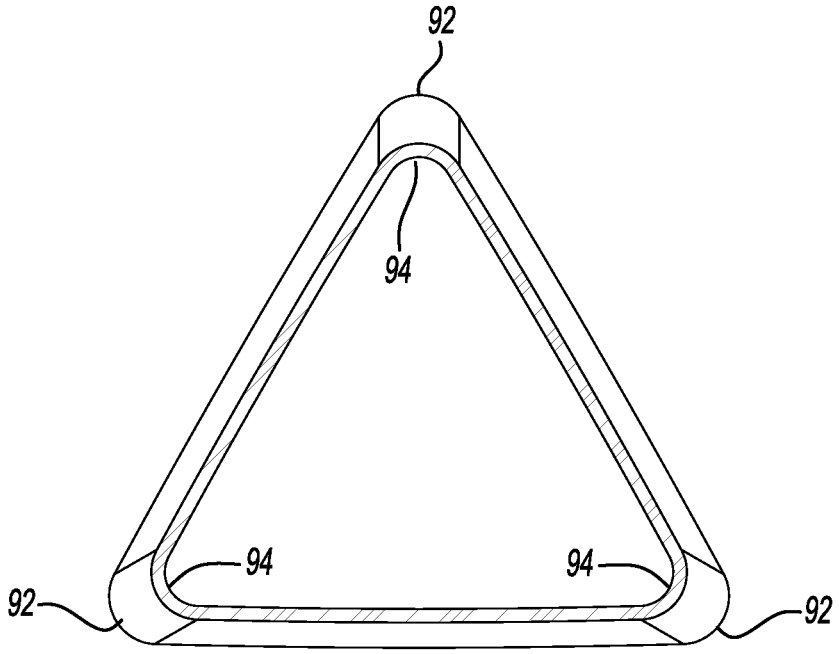
FIG. 17 is a view of the hot-fill container of FIG. 8 at line 17-17 of FIG. 15.

FIG. 15 depicts the container 60 and section lines 16-16 and 17-17. FIG. 16 depicts the view from the vantage of section line 16-16, and FIG. 17 depicts the view from the vantage of section line 17-17. More specifically, FIG. 15 depicts a side view of the container 60 of FIG. 8 and orientation of the panel 72 with an hourglass structure. The view of FIG. 16 depicts corner edge points 90 and bottom corners 92 being aligned, or coinciding, when viewed from above the container 60 at the section line 16-16. Similarly, the view of FIG. 17 depicts the corner edge points 94 and the bottom corners 92 being slightly out of alignment, or not coinciding, when viewed from above the container 60 at the section line 17-17. Together, the FIGS. 15-17 further exemplify the hourglass shape of the panels 72, and the concavity of the panels 72 with a central section 84 that is closer to a central vertical axis 50 than other portions of the panel 72.

Thus, FIGS. 8-17 depict a container 60 that has at least three broad panels 72 that may all be identical or has at least two panels out of three panels that are identical. The height of each panel may be at least forty percent (40%) of the overall height of the container 60, but not more than ninety percent (90%) of the container 60. An example of one embodiment is a container 60 in which the panel 72 is fifty to eighty percent (50-80%) of the overall height of the container 60. Regarding the exterior surface area of the panel 72 relative to the overall exterior surface area of the container 60, in one example, the exterior surface area of each panel 72 accounts for at least fifteen percent (15%) of the overall surface area of the container 60. The total surface area of all broad panels 72 combined for a given container 60 may account for at least forty-five percent (45%) of the overall exterior surface area of the container 60. In another example, the exterior surface area of each panel 72 accounts for at least eighteen percent (18%) of the overall exterior surface area of the container 60. In the FIGS. 8-17, which are to scale, the panels 72 form an hourglass structure or shape, and other proportions of the panel 72 are conceivable yet still forming an hourglass shape, regardless of viewing direction of the container 60. Stated differently, whether the panel 72 is viewed nearly directly head-on, as in FIG. 15, or from an angle as in FIGS. 8, 9, 11, etc. the panel 72 will still have an hourglass appearance.

FIGS. 1-7 depict a container 10 whose sidewalls or body 26 depict an hourglass structure or shape with panels 12 and 52; however, the hourglass structure may be supported or strengthened by circular or semi-circular grooves 32, 34, 36 to restrict panel 12, 52 movement during vacuum formation and release, and to provide a stronger area for hand gripping relative to a container with no grooves 32, 34, 36, assuming that all else is the same regarding two such containers.

Figure 18:
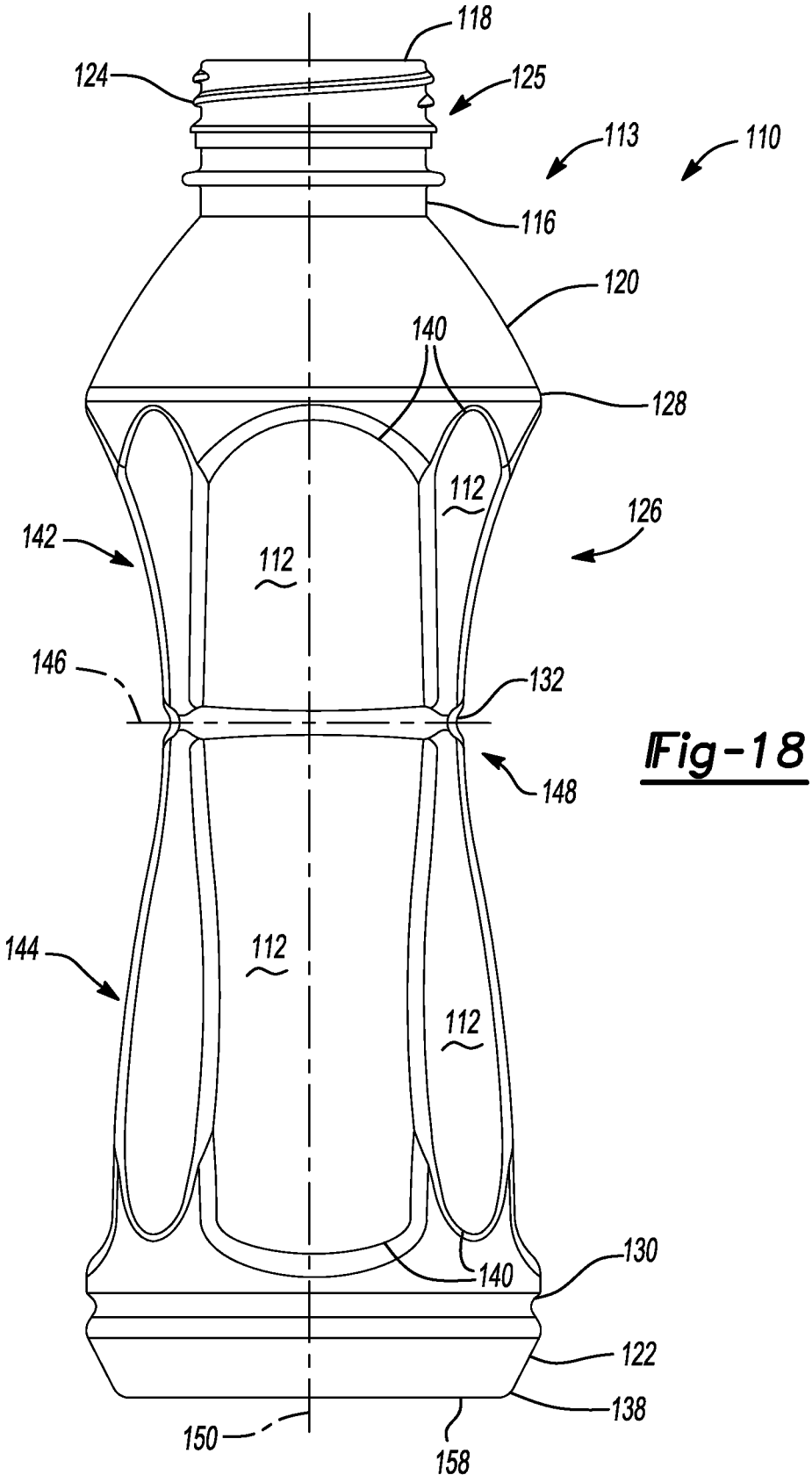
FIG. 18 is a side view of a third embodiment of a hot-fill container depicting numerous flat wall panels.

Turning now to FIG. 18, details of the embodiments of the present teachings will be presented. More specifically, FIG. 18 depicts a perspective view of a third embodiment of a hot-fill, blow molded plastic container 110 that exemplifies principles and structure of the present invention. The internal volume of the container 110 is designed to be filled with a product, typically a liquid such as a fruit juice or sports drink, while the product is in a hot state, such as at or above 180° F. After filling, the container 110 is sealed, such as with a cap and cooled. During cooling, the volume of the product in the container 110 decreases which in turn results in a decreased pressure, or vacuum, within the container 110. While designed for use in hot-fill applications, it is noted that the container 110 is also acceptable for use in non-hot-fill applications.

Since the container 110 is designed for "hot-fill" applications, the container 110 is manufactured out of a plastic material, such as polyethylene terephthalate ("PET"), and is heat set ("HS") enabling such that the container 110 is able to withstand the entire hot-fill procedure without undergoing uncontrolled or unconstrained distortions. Such distortions may result from either or both of the temperature and pressure during the initial hot-filling operation or the subsequent partial evacuation of the container's interior as a result of cooling of the product. During the hot-fill process, the product may be, for example, heated to a temperature of about 180° F. or above and dispensed into the already formed container 110 at these elevated temperatures.

As depicted in at least FIG. 18, the container 110 generally includes an upper portion 113 having a neck 116 and defining a mouth 118, a shoulder portion 120, and a bottom portion 122. As depicted, the shoulder portion 120 and the bottom portion 122 are substantially annular or circular in cross-section. The cap engages threads 124 on a finish 125 to close and seal the mouth 118. The neck 116 lies below the finish 125.

Extending between the shoulder portion 120 and the bottom portion 122 is a sidewall or body 126 of the container 110. As depicted in FIG. 18, the body 126 has a variety of cross-sectional shapes. Near the transition between the shoulder portion 120 and the sidewall or body 126 is a rib or groove 128, which provides sidewall strength to the container 110 and which is generally circular. A corresponding rib or groove 130 may be located between the body 126 and bottom portion 122. The grooves 128, 130 with their positions near the top and bottom of the container 110, assist in maintaining the overall cylindrical shape of the container 110. Within and throughout the body 126 between the shoulder portion 120 and the bottom portion 122, the cross-sectional and sidewall shapes vary due to employment of flat wall panels 112 and one or more additional strengthening grooves 132 within the midst of such flat wall panels 112 and the sidewall or body 126. On the inside of the container 110, the groove 132 forms a rib, which strengthens the body 126, also known as a sidewall.

Before continuing with a description of the container body 126, a brief description of the shoulder portion 120 and bottom portion 122 will be provided. The container shoulder portion 120 is generally of a conical shape with a narrower cross section that joins or forms into the neck 116 while the opposite end of the shoulder portion 120 has a larger cross section and meets with the body 126, with groove 128 disposed therebetween as part of the transition. The bottom portion 122 of the container 110 may have a chime 138 located between a container bottom contact ring 158, which contacts a surface upon which the container rests, and the bottom groove 130.

The embodiment of the container depicted in FIG. 18 may employ multiple flat panels 112 in its body 126, which will now be discussed. The container 110 depicts numerous flat panels 112, with a top group of flat panels 142 above a horizontal centerline 146 of the container 110 and a bottom group of flat panels 144 below a horizontal centerline 146 of the container 110. The flat panels 112 in the body 126 have the utility of absorbing internal vacuum within the container during container product cooling. The groove 132 serves the purpose of resisting sidewall deformation and adding strength to the midsection 148, which is a hand gripping area, of the container 110 so that a user may grasp and hold the container 110 without deformation in the sidewall as the cap is removed which may result in outward expansion of the container body 126. Contraction of the container body 126 generally results in body movement toward a central vertical axis 150, while expansion of the container body 126 generally results in body movement away from the central vertical axis 150.

More specifically, the container 110 may employ numerous flat wall panels 112 as part of the upper group of flat panels 142 and the lower group of flat panels 144 to absorb and displace liquid during internal volume decreases due to hot-fill product cooling. The panels 112 may be defined by a combination of groove 132 and/or variations in the container profiles, such as a concavity or convexity. The size, shape and location of the panels 112 may determine the method and extent of deformation as the panels 112 absorb the internal vacuum. For instance, larger panels may undergo more drastic deformation, as may be the case for portions of the panels at the farthest or most distant portion from a rib or more rigid structure. The deflective action or extent of the panels 112 may further be controlled by varying the convexity and/or concavity of the surface of the panel, both vertically and horizontally, along with the wall thickness of the panels 112. The location of the panels 112 may also help in determining the wall thickness of the panel. For instance, panels placed on relatively larger cross-sectional areas and closer to the horizontal centerline 146 of the container 110 tend to have less average material thickness and be more flexible. Larger panels will be described later in conjunction with another embodiment. The grooves, profiles and/or cross-sections that surround the panels 112 act as reinforcements to provide strength to the container 110 so that the container 110 maintains its basic shape and achieves other performance requirements.

The container 110 may incorporate two or more relatively flat panels 112 and result in generally polygonal cross-sectional shapes. The container 110 may have an hourglass appearance when viewed in a side view from any side of the container. To provide an hourglass appearance, the panels 112 may vary in width such that the panels near or proximate the horizontal centerline 146 may be smaller. The structural design or shape of the flat panels directly affects how responsive the panel will be to an internal vacuum. That is, the degree or amount of panel movement toward the central vertical axis 150 directly depends upon the degree of flatness of the panels 112. More specifically, if a panel is not completely flat, but is either concave inward or concave outward, the panel may be resistant to movement. In other words, the closer to "flat" or flatter that a panel is initially, upon container formation, the more responsive it will be to small movements due to internal vacuum. Because a flat panel represents the shortest distance between two points, such as points at the perimeter of the panel, the supporting surfaces must be flexible enough to allow the panel to buckle inward in order for it to absorb or respond to a large vacuum pressure. It should also be recognized that panels 112 can include arcuate or other shaped sections 140. These shaped sections 140 can provide a transition between panels 112 and the adjoining areas associated with grooves 128, 130.

Regarding the shape of container panels, also referred to as vacuum panels 12, 52, 72, 112 in FIGS. 1-18, the closer, or more nearly, the panels are to being flat, and not concave or convex, the more responsive the panel will be to vacuum pressure within the container, and any force applied from outside of the container, such as from a human hand during gripping. The flat panel represents the shortest distance between two points and thus, the supporting surfaces must be flexible enough to allow the panel to buckle inward, toward the central vertical axis, in order for the panel to absorb relatively small and large amount or quantities of vacuum pressure.

The vacuum panels of the embodiments of FIGS. 1-18 are designed to move and compensate for internal vacuum in one of two methods. In one method, if a panel is molded to be concave and has a curve to it such that the central portion of the panel is closer to the central vertical axis than its peripheral portions, the panel is predisposed to move in a specific direction, such as toward the central vertical axis of a container, and at a specific place, such as at the central portion or center of the panel. However, because the panel may already be predisposed or oriented to move inward, either the structure supporting the panel, such as the surrounding structure, must possess the capability to move inward or the surface of the panel must be designed to buckle or move in a specific way for the panel to be able to absorb vacuum.

In another method, if a panel is molded to be convex and has a curve to it such that the central portion of the panel is farther from the central vertical axis than its peripheral portions, the panel may be generally capable of compensating for a larger container volume reduction upon cooling of a hot-fill liquid. However, when a panel is convex, the panel geometry generally will require a greater amount of force, as compared to a concave panel, to make the panel collapse inward and ultimately cause the convex panel to "snap through" and become, in one example, convex. "Snap through" is meant to mean that the panel moves from outside of the container to inside of the container, or in other words, the panel moves from one side, the outside side, of the general outside surface of the container to the other side, the inside side, of the general outside surface of the container. The container geometry has to be engineered to provide both, the required amount of support to maintain the general container shape and it has to provide support for and allow for movement of the vacuum absorbing panels toward the central vertical axis during product cooling.

Regarding the geometry of the panels 12, 52, 72, 112 of the embodiments depicted in FIGS. 1-18, the geometry is considered to be flat or smooth in that the panels are smooth surfaced and do not have any grooves running through the panels 12, 52, 72, 112; however, panels 12, 52, 72, 112 that are adjacent to each other may be separated by grooves 32, 34, 36, 132, or junctured with an angle therebetween, such as in FIGS. 3 and 4 regarding the panels 52. Stated in other words, the entire panel surface of panels 12, 52, 72, 112 may be smooth (completely smooth), grooveless, and uninterrupted with a vacuum initiator or vacuum groove, or other device to otherwise cause or provoke movement in the panel due to an internal vacuum.

It should be recognized that in some embodiments, some or all of grooves 28, 30, 32, 34, 36, 128,130, 132 can define a circular cross-section when view from above (i.e. see FIG. 4). However, adjacent panels 12, 52, and/or 112 can define a non-circular cross-section. In some embodiments, these adjacent panels 12, 52, and/or 112 can define a square shape, rectangular shape, hexagonal shape, octagonal shape, or other shape having generally similarly proportioned panel sizes. For example, as seen in FIG. 3, panels 12 can together define a generally square or rectangular shape having outwardly or convex panels 12. As seen in FIG. 1, the combination of panels 12 and/or 52 can form a non-circular region adjacent the circular region of grooves 28, 30, 32, 34, 36, 128, 130, 132. In the case of panels 58 and grooves 32, 34, 36 of FIGS. 1-7, several advantages can be realized in connection with the present embodiment. Specifically, controlled vacuum absorption can be realized in center of the container due to square and/or rectangular cross section. The panels service to absorb vacuum forces as described herein. Moreover, the vertical corners between panels 12 and between panels 52 provide improved top loading capability in the square and/or rectangular mid-section of container. Still further, the present arrangement provides round contact point for fill line handling, yet square-shaped mid-section. These square and/or rectangular sections permit square or rectangular billboards for label graphics, which are highly desired. Furthermore, the generally flat surfaces areas of panels 12 and 52 provide enhance grip for a user. Consequently, the present teachings are able to combine the unique advantages of both circular cross-sections with generally flat-paneled cross-sections in a novel arrangement.

In accordance with the description above, a container 10, 110 may utilize or employ, as a plastic molded unit, an upper portion 13, 113 having a neck 16, 116 and defining a mouth 18, 118, a shoulder portion 20, 120 formed with the neck 16, 116 and extending away from the neck 16, 116, a bottom portion 22, 122 forming a container base with a contact ring 58, 158, a body 26, 126 extending between and joining the shoulder portion 20, 120 and the bottom portion 22, 122, and a plurality of vacuum panels 12, 112 with a smooth surface formed in the body 26, 126. The vacuum panels 12, 112 are separated by one or more strengthening grooves 32, 34, 36, 132 to create panels 52, in some embodiments. The strengthening grooves 32, 34, 36, 132 are continuous and circular around the container periphery or circumference. The smooth vacuum panels 12, 112 are grooveless in that there are no interruptions in the surface of the vacuum panels 12, 112. Interruptions may be vacuum initiators or grooves that begin and end in the surface of the panel 12, 112. In some embodiments, the smooth vacuum panels 12, 112 may be separated by a plurality of continuous circular grooves that provide a hand gripping area of smaller panels 52, compared to the panels 12, 112. The container 10, 110 in a profile view, such as when viewed along a sight line coincident with the horizontal centerline 46, 146, forms an hourglass shape to a viewer.

The plurality of circular grooves 32, 34, 36 may be at a plurality of different depths relative to the same panels 12, 52 in the container body 26, and be molded in the periphery or circumference of the container. The vacuum panels 52 in cross-section may form four semi-circular sections that together form the container body 26, as in FIGS. 3 and 4. The continuous grooves 32, 34, 36 in cross-section, between the vacuum panels, form a circle with a cross-sectional area smaller than a cross-sectional area formed by the enclosed container wall of the vacuum panels 12, 52.

In another embodiment, a container 60 may employ or utilize an upper portion 61 including a neck 62 and defining an opening 66, a shoulder portion 68 formed with the upper portion 61 and extending away from the upper portion 61, a bottom portion forming a base, and a sidewall panel 72 extending between and joining the shoulder portion 68 and the bottom portion such that the sidewall panel 72 has at least one smooth, grooveless, vacuum panel 72. A smooth, grooveless vacuum panel is one in which the surface of the panel itself has no grooves, such as a vacuum initiator, in it although vacuum panels themselves may be separated by grooves 32, 34, 36. The sidewall may further employ three smooth, grooveless, vacuum panels that may form a triangle when the container body is viewed in cross-section. Still yet the vacuum panels 72 may be concave inward toward a central vertical axis 50 such that the center section 84 of the panel 72 is the closest part of the panel 72 to the central vertical axis 50. The top longitudinal end 74 of the panel 72 and the bottom longitudinal end 76 of the panel 72 may be equidistantly farthest from the central vertical axis 50, with regard to the panel 72. The vacuum panels 72 may have an hourglass shape when the container 60 is viewed in a side view, such as coincident with a central horizontal axis. The shoulder portion and the base portion, to which the vacuum panels are molded, may be coincident, regarding their outer perimeters for example, when viewing the container from the top or bottom.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A container comprising:

an upper portion defining a mouth;

a shoulder portion formed with the upper portion and extending away from the upper portion;

a bottom portion forming a base;

a sidewall extending between and joining the shoulder portion and the bottom portion;

a plurality of smooth vacuum panels formed in the sidewall, the plurality of smooth vacuum panels are grooveless and form a rectangular shape in cross-section; and a plurality of continuous circular grooves separating the smooth vacuum panels and extending around a periphery of the containers;

wherein each one of the plurality of continuous circular grooves are at a plurality of different depths relative to the container sidewall, around a periphery of the container.

2. The container of claim 1, wherein the plurality of continuous circular grooves are strengthening grooves.

3. The container of claim 1, wherein the plurality of continuous circular grooves provide a hand gripping area.

4. The container of claim 1, wherein the container in a profile view forms an hourglass shape.

5. The container of claim 1, wherein the plurality of continuous circular grooves in cross-section, between the vacuum panels, form a circle with an area smaller than a cross-sectional area of the vacuum panels.

6. The container of claim 1, wherein at least one of the shoulder portion and the bottom portion form a circular shape in cross-section, the sidewall transitioning from the rectangular shape to the circular shape.

7. A container comprising:

an upper portion defining a mouth;

a shoulder portion formed with the upper portion and extending away from the upper portion;

a bottom portion forming a base;

a sidewall extending between and joining the shoulder portion and the bottom portion, the sidewall including four smooth, grooveless vacuum panels forming a rectangle in cross-section; and a plurality of continuous circular grooves separating each one of the four smooth, grooveless vacuum panels and extending around a periphery of the container, each one of the plurality of continuous circular grooves has a plurality of different depths relative to the sidewall.

8. The container of claim 7, wherein the vacuum panels are concave inward toward a central vertical axis of the container.

9. The container of claim 8, wherein the vacuum panels have an hourglass shape when the container is viewed in a side view.

10. The container of claim 9, wherein the shoulder portion and the base portion, to which the vacuum panels are molded to, are coincident from a top.

11. The container of claim 7, wherein at least one of the shoulder portion and the bottom portion form a circular shape in cross-section, the vacuum panels transitioning from the rectangular shape to the circular shape.

12. A container comprising:

an upper portion defining a mouth;

a circular shoulder portion formed with the upper portion and extending away from the upper portion;

a circular bottom portion forming a base;

a sidewall extending between and joining the shoulder portion and the bottom portion, the sidewall including four smooth, grooveless vacuum panels forming a rectangle in cross-section; and a plurality of continuous circular grooves separating each one of the four smooth, grooveless vacuum panels and extending around a periphery of the container, each one of the plurality of continuous circular grooves has a plurality of different depths relative to the sidewall, the plurality of continuous circular grooves provide a hand gripping area;

wherein the container has an hourglass shape in a profile view; and wherein each one of the plurality of continuous circular grooves is recessed furthest within the sidewall at vertical corners of the container.

13. The container of claim 12, wherein the plurality of continuous circular grooves in cross-section form a circle with an area smaller than a cross-sectional area of the vacuum panels.

* * * * *